United States Patent [19]

Tsuihiji et al.

[11] Patent Number: 5,067,704

[45] Date of Patent: Nov. 26, 1991

[54] DOUBLE-FEED SHEET DETECTION APPARATUS

[75] Inventors: Yutaka Tsuihiji, Tama; Akio Sakayori, Zama, both of Japan

[73] Assignee: Tokyo Aircraft Instrument Co., Ltd., Tokyo, Japan

[21] Appl. No.: 504,604

[22] Filed: Apr. 5, 1990

[51] Int. Cl.[5] ..... B65H 7/14

[52] U.S. Cl. ..... 271/262; 271/256; 271/258; 271/263

[58] Field of Search ..... 271/256, 258, 262, 263,

[56] References Cited

U.S. PATENT DOCUMENTS

| | | | |
|---|---|---|---|
| 3,778,051 | 12/1973 | Allen et al. | 271/263 |
| 3,932,272 | 1/1976 | Carnes, Jr. et al. | 271/263 |
| 4,160,546 | 7/1979 | McMillan . | |
| 4,258,326 | 3/1981 | Johne | 271/258 |
| 4,428,041 | 1/1984 | Honkawa | 271/263 |
| 4,571,055 | 2/1986 | Nishiyama | 271/258 |
| 4,591,145 | 5/1986 | Cherian | 271/258 |
| 4,652,742 | 3/1987 | Wauer et al. | 271/263 |
| 4,670,647 | 6/1987 | Hubble, III et al. | 271/263 |

FOREIGN PATENT DOCUMENTS 2165045 4/1986 United Kingdom .

*Primary Examiner*—David H. Bollinger
*Assistant Examiner*—S. Kennemore
*Attorney, Agent, or Firm*—Spencer & Frank

[57] ABSTRACT

An apparatus for detecting double-feed of sheets of paper with a light-transmission sensor. The light-transmission sensor is composed of a light emitting source, such as an LED, and a light receiving sensor located on both sides of a paper transport path. Before the first sheet is fed, the gain of a variable gain amplifier, which amplifies an output of the light receiving sensor, is present at a predetermined value so that an output level of the amplifier may be appropriate. When the first sheet passes the light transmission sensor, an output level of the variable gain amplifier is measured and the level for a sheet is stored. Each time a sheet is fed in the sequential paper feeding operation, the output level of the amplifier is measured and compared with the stored data to detect double-feed of sheets. If the level is not appropriate, the intensity of the light emitting source is controlled in order to correct the level.

8 Claims, 8 Drawing Sheets

DOUBLE-FEED SHEET DETECTION APPARATUS

BACKGROUND OF THE INVENTION

The present invention relates to a double-feed sheet detection apparatus for detecting a double-feed of sheets of paper in a printer and the like which feeds sheets one by one sequentially.

Conventionally, a double-feed sheet detection apparatus, which uses a light-transmission sensor, is known. FIG. 5 is a block diagram of a conventional double-feed sheet detection apparatus. A paper transport path is constructed between a light emitting lamp 1 and a light receiving sensor 2. Output from the light receiving sensor 2 is amplified by an amplifier 3 and converted from analog to digital by an analog-to-digital (A/D) converter 4. The converted output is then input through an input/output (I/0) circuit 51 to a central processing unit(CPU) 61. The gain of the amplifier 3 is controlled by a gain control circuit 91, and the intensity of the light from the light emitting lamp 1 is controlled by a lamp control circuit 100.

FIGS. 6A and 6B illustrate a flow chart showing operational steps performed in a conventional double-feed sheet detection apparatus. In the case of using the conventional apparatus, an operator judges the thickness of a sheet of paper and sets a switch at an optimum signal level for the thickness of the sheet. Thereafter, the apparatus stores a level of the first sheet. The apparatus then judges whether the number of sheets being fed is one or more than one, based on the stored level.

The operation process will be explained according to the above-mentioned flow chart. The process includes the following steps:

in Step 200, an operator sets a sheet of paper in a paper feeder;

in Step 201, the operator judges whether or not the sheet is thick;

in Step 202, if the operator judges the sheet is not thick in the former step, he judges whether or not the sheet is thin;

in Step 203, if the operator judges the sheet is not thin, he sets a switch at an optimum level for a standard sheet of paper;

in Step 215, when the operator judges the sheet is thick in Step 201, he sets the switch at an optimum level for a thick sheet and goes on to Step 204;

in Step 217, when the operator judges the sheet is thin in Step 202, he sets the switch at an optimum level for a thin sheet and goes on to Step 204;

in Step 204, feeding of the sheets is started;

in Step 205, it is judged whether or not a sheet is fed;

in Step 206, if it is judged that the sheet is fed in the former step, a level of the fed paper is measured;

in Step 207, a level of double-feed is set based on the measurement result;

in Step 208, it is judged whether or not the sheet is ejected;

in Step 209, if it is judged that the sheet is ejected in the former step, it is judged whether or not a subsequent sheet is fed;

in Step 210, if it is judged that the subsequent sheet is fed in the former step, the level of the sheet is measured;

in Step 211, it is judged whether the measured level is under the level of two sheets or not;

in Step 212, if it is judged that the measured level is not under the level of two sheets, it is judged whether or not all of the sheets are fed. If they are not, Step 208 is repeated; and in Step 213, if it is judged that all of the sheets are fed in the former step, the apparatus stops its operation.

However, in such a conventional apparatus, several problems arise. For example, it is required that the signal level from the light sensor be preset by adjusting its volume with a standard sheet of paper set in the sensor. Ordinarily, the preset signal level is fixed.

Furthermore, since paper dust becomes attached to the light sensor or its performance is degraded by the elapse of time, its light signal is lowered. As a result, the apparatus makes incorrect decisions. In addition, if the base color of paper is other than white, its light transmittance is different from that of white paper of the same thickness. Therefore, it is impossible to set a switch based only on the thickness of paper.

SUMMARY OF THE INVENTION

An object of the invention is to provide a double-feed sheet detection apparatus for detecting the double-feed of sheets of paper with a light-transmission sensor, wherein exact detection is possible, even if changes are caused by time-elapse in the apparatus or even if different types of paper are used, by automatically adjusting the intensity of the light emitting source and the gain of the amplifier for amplifying the signals of the light-transmission sensor in accordance with a predetermined process.

In order to achieve the above object of the present invention, there is provided a double-feed sheet detection apparatus which comprises a light-transmission sensor wherein a paper transport path is constituted between a light emitting source and a light receiving sensor, a light control circuit for controlling the intensity of the light emitting source, a variable gain amplifier for amplifying the output of the light-transmission sensor, and a central processing unit (CPU) for setting the intensity of the light emitting source and the gain of the amplifier, and for judging whether a double-feed is caused or not, based on the output of the amplifier.

The CPU executes the following steps: an initiation step of initiating the apparatus when its operation is started; a temporary setting step of setting temporarily the light intensity of the light emitting source and the gain of the amplifier; a gain adjustment step of adjusting the gain of the variable gain amplifier so that an output level of the variable gain amplifier may be a constant value, which is not in a saturation state, when no sheet of paper exists between the light emitting source and the light receiving sensor; a preparation step of preparing a double-feed sheet detection state by adjusting the output of the light emitting source so that, when a sheet of paper to be measured is supplied into the paper transport path, the output for the sheet of the variable gain amplifier may be on a medium level and lower than the level of the output of the variable gain amplifier during the period when no sheet is being fed; a detection output transmission step of transmitting double-feed sheet detection output when an output lower than a fixed level, which is much lower than the level during the period when the sheets are being fed, is detected in the sequential feeding operation; and a correction step of observing the output while the sheets are being fed one by one and of increasing the output of the light emitting source when the reduction of the output is found.

The light emitting source of the light-transmission sensor is an LED. The light control circuit for controlling the light intensity of the light emitting source can be a circuit which selects a load resistance of the LED in response to a signal from the CPU.

The gain of the variable gain amplifier for amplifying output of the light-transmission sensor can be controlled by selecting a feedback resistance in response to a signal from the CPU.

The gain adjustment step may comprise a step of giving a warning, displaying a prohibition of paper feed, and stopping its operation when the output level, during the period when no sheet is being fed, cannot be adjusted to a fixed value, which is not in the saturation state.

DETAILED DESCRIPTION OF THE PREFERRED EMBODIMENTS

The present invention will be described in detail with reference to preferred embodiments in conjunction with the accompanying drawings.

Figure 1:
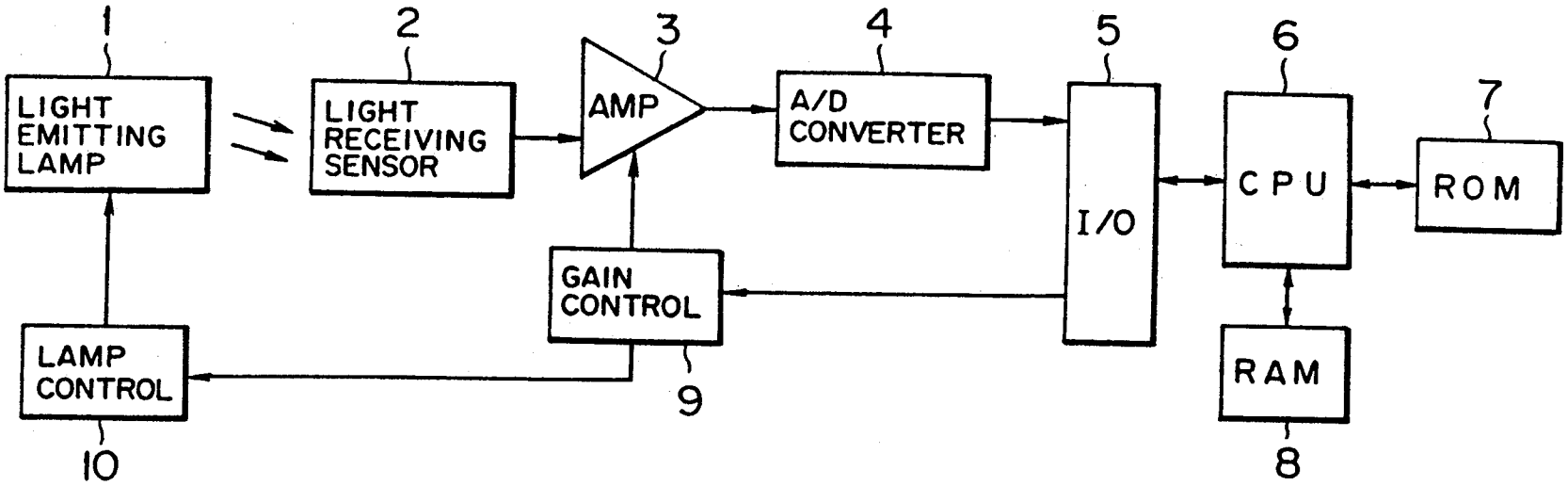
FIG.1 is a block diagram of an embodiment of a double-feed sheet detection apparatus according to the invention.
Figure 2:
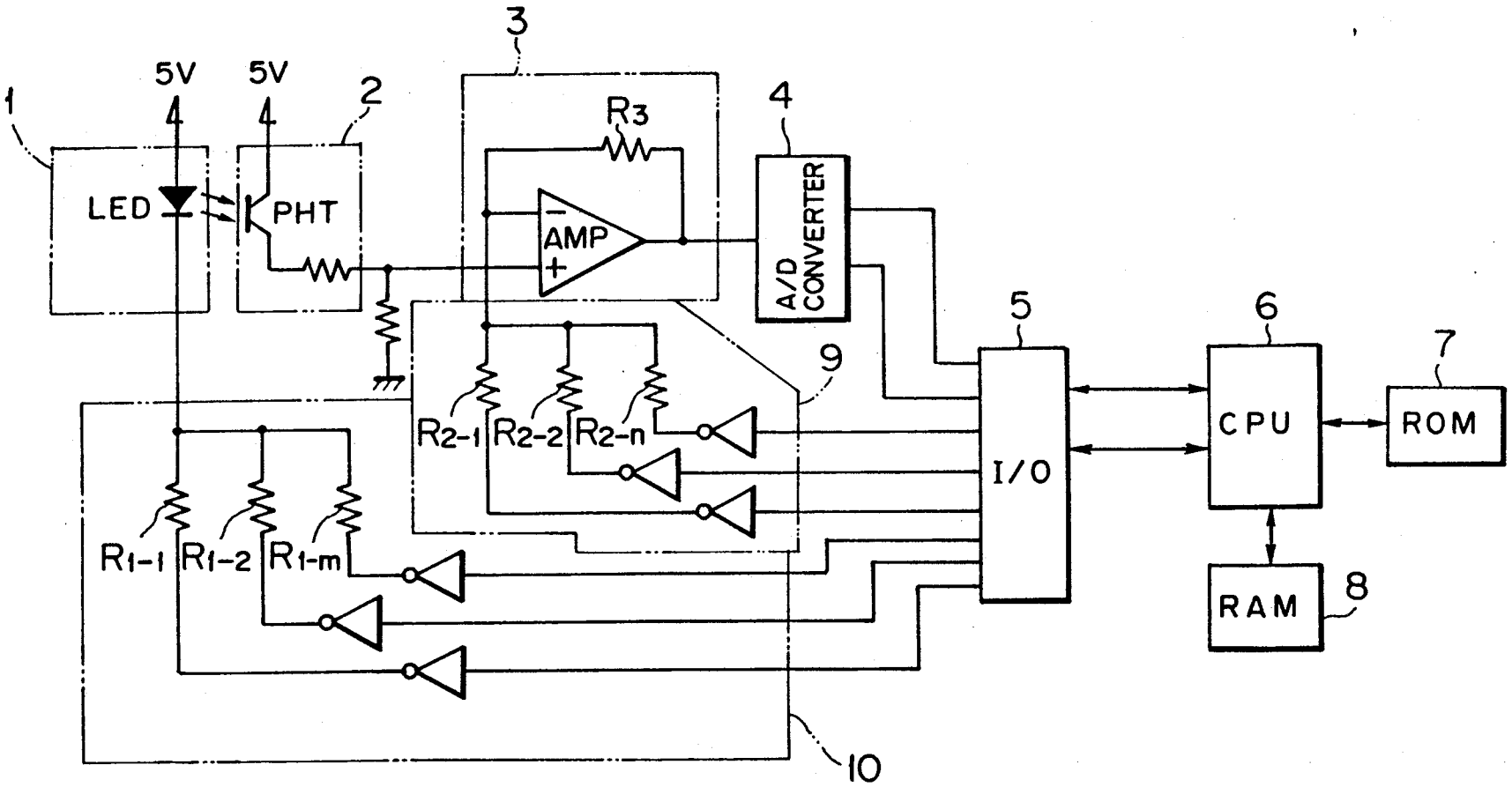
FIG.2 is a detailed view of a circuit in the embodiment of the invention.

FIG.1 is a block diagram of an embodiment of the doublefeed sheet detection apparatus of the invention and FIG. 2 is a detailed view of a circuit in a part of the embodiment. A paper transport path is constituted between a light emitting lamp 1 and a light receiving sensor 2. As shown in FIG. 2, as a light emitting element of the light emitting lamp 1, an LED is used. A lamp control circuit 10 is constituted by load resistances $R_{1-1}$, . . .,$R_{1-m}$ selectively connected with the LED and inverters respectively corresponding to the load resistances. Furthermore, each inverter is connected with an I/0 circuit 5. The intensity of the light from the LED is adjusted by selectively connecting either of the load resistances with the LED. The gain of an amplifier 3 for amplifying the output of the light receiving sensor is controlled by a gain control circuit 9, and the amplifier 3 and the gain control circuit 9 constitute a variable gain amplifier as a whole. As shown in FIG.2, the gain control circuit 9 is constituted by the resistances $R_{2-1}$, . . ., $R_{2-n}$ and the inverters respectively corresponding to the resistances, and each inverter is connected with the I/0 circuit 5. Since the gain of the amplifier 3 is determined by R: and $R_{2-i}$, any one of $R_{2-1}$, . . ., $R_{2-n}$ is selectively switched in response to a control signal from the CPU 6 in the invention. The output of the amplifier 3 is converted from analog to digital by an analog-to-digital converter 4 and input to a central processing unit (CPU) 6, with which ROM 7 and RAM 8 are connected, through the I/0 circuit 5.

Figure 4:
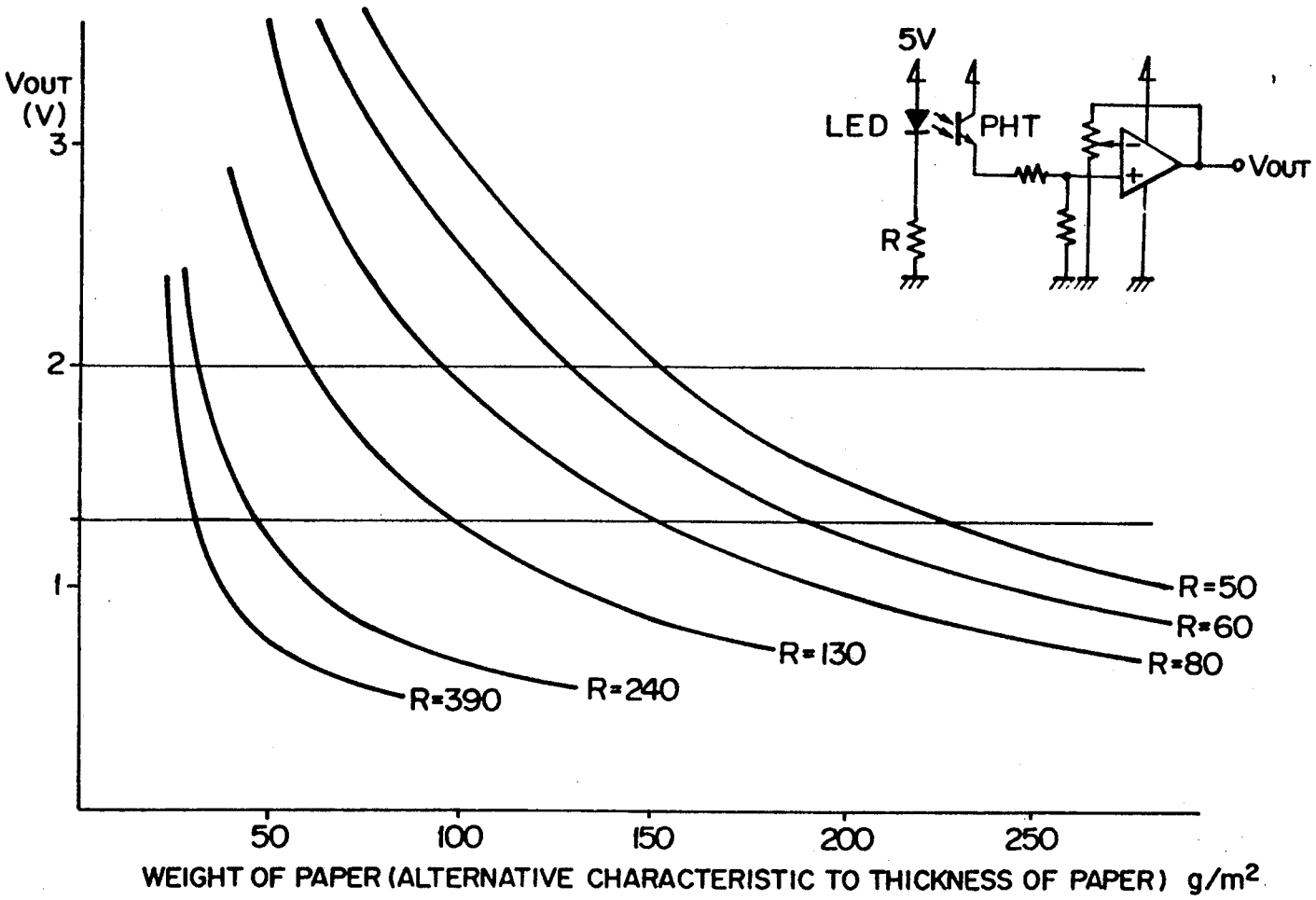
FIG. 4 is a graph showing a relationship among the paper thickness, light intensity and the amplified output of a sensor.
Figure 5:
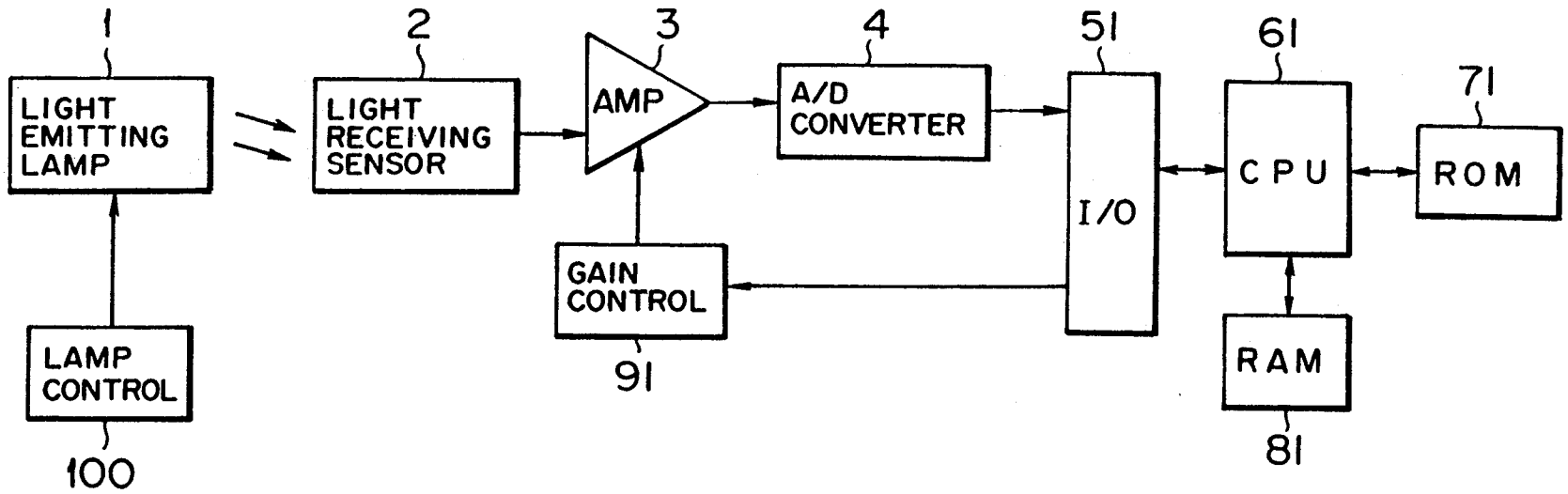
FIG. 5 PRIOR ART
FIG. 5 is a block diagram of a conventional double-feed sheet detection apparatus.
Figure 6A:
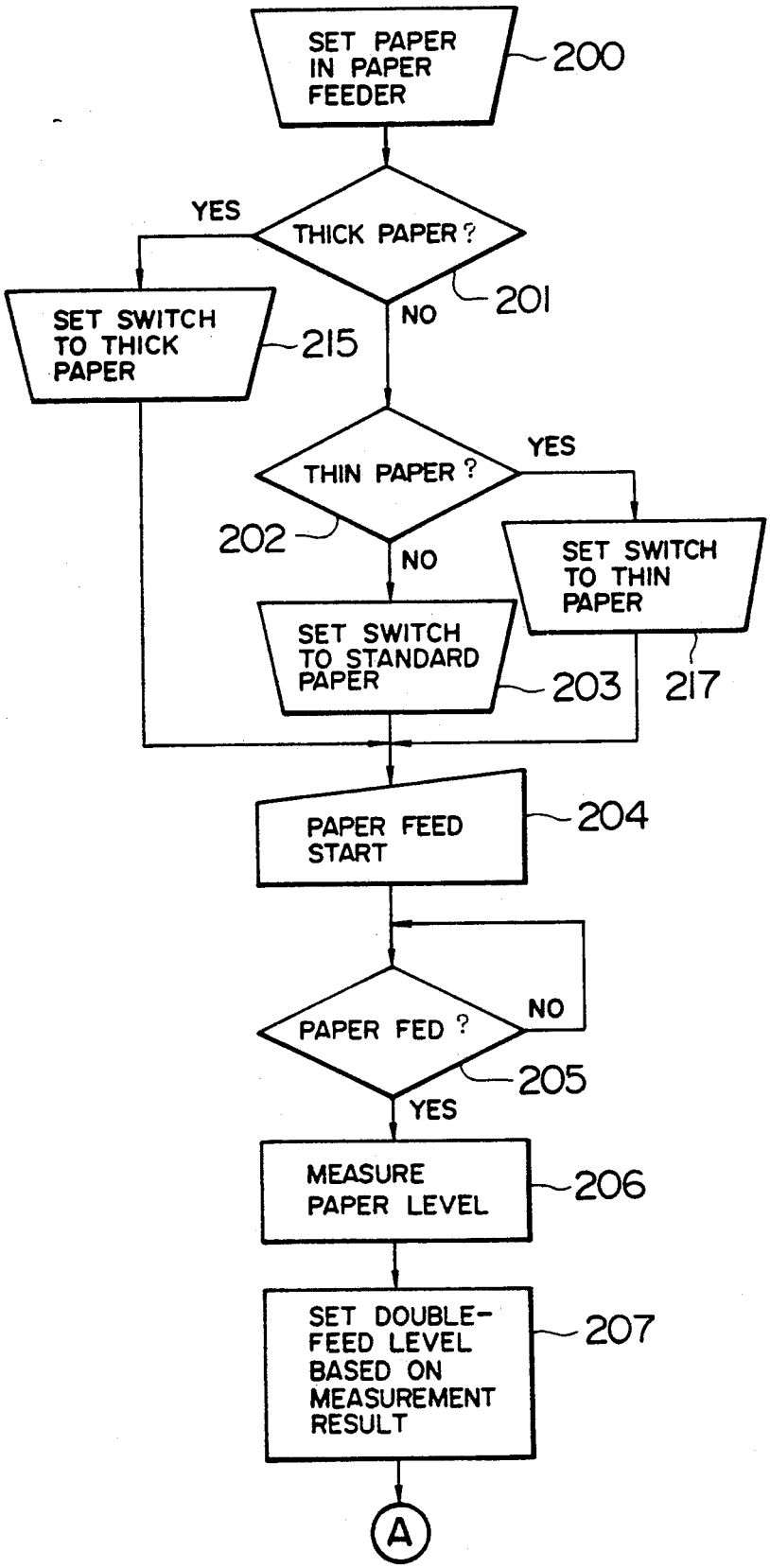
FIG. 6A PRIOR ART
FIG. 6A and 6B are flow charts showing the operation process of the conventional double-feed sheet detection apparatus.
Figure 6B:
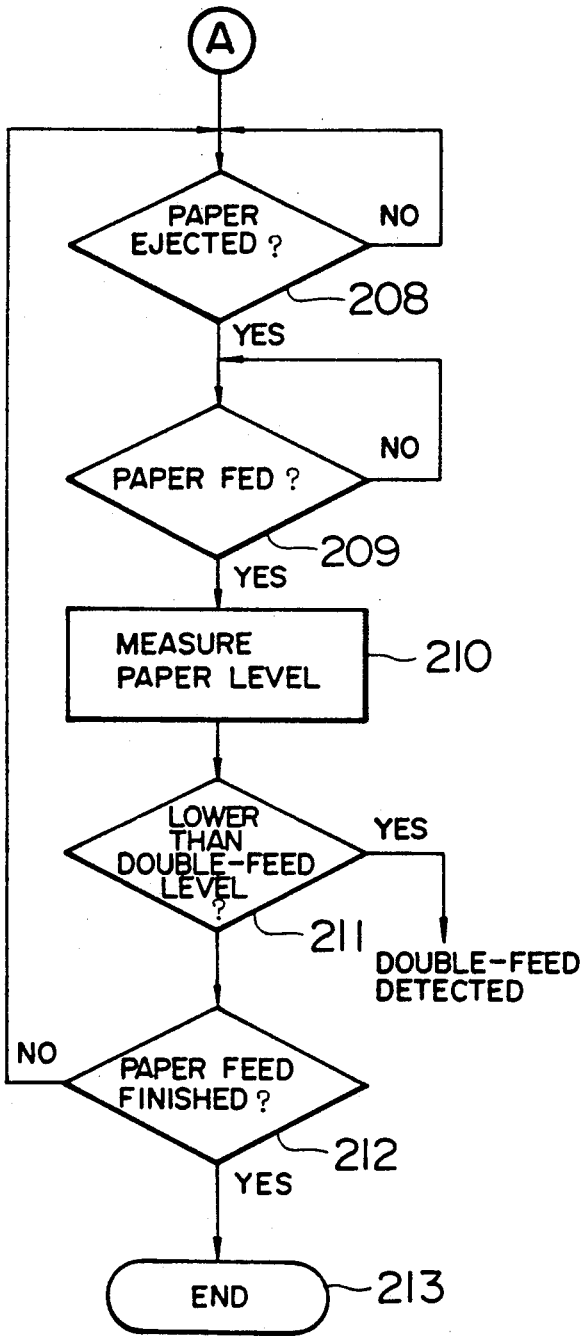
FIG. 6B PRIOR ART

Referring to FIG.4, there is a graph showing the relationship among the paper thickness, the light intensity and the output from the sensor. The light transmittance of paper is generally determined by the weight ($g/m^2$) of the paper.

In the present invention, the adjustment operation of a regular output of the amplifier 3 can be automatically performed, and an optimum electric output can be also automatically gained based on the light transmittance of the paper. Furthermore, the apparatus of the invention does not adjust the gain of the amplifier with standard paper inserted in the light sensor, but attains the same condition as that in which the standard paper is inserted by reducing the output of the light emitting source. Then, the gain of the amplifier is switched so that a signal level may be optimum. While the gain is set at the beginning of the operation of the apparatus, during the actual paper feeding, a level of a sheet is detected, the light intensity of the light emitting lamp is switched and the level of output of the sensor, when the sheet passes the light sensor, is made optimum. Simultaneously, a level for double-feed detection is also set.

The operation program of the CPU will now be explained briefly. When the power of the apparatus is turned on, the output of the amplifier is measured and set so that the light intensity of the light emitting source is as low as it is when a sheet of standard paper is inserted in the light sensor (Steps 100–107). Based on the measurement results, it is judged whether the output of the amplifier is at an optimum level (in the embodiment, since the power of 5V is used, about 2V is an optimum value of output). If it is not at an optimum level, the gain is reset and the output of the amplifier is measured again (Steps 108–116). Thus, the above steps are repeatedly executed so that an optimum value can be obtained. If the LED is degraded or the sensor is dirty, the first measurement value is lower than an actual value. However, it is possible to obtain an optimum value by repeating the operation of setting the gain. The CPU can automatically cope with the accumulated dust of the sensor and the deterioration of the LED.

Next, the paper feeding is started. When the first sheet of paper passes the sensor, the output of the amplifier is measured and the level of a sheet is stored, based on the measurement results. Naturally, the output level differs according to the type of paper. Furthermore, even if the output is measured at several points of the same sheet, it is not always the same. Therefore, it may be impossible to compare the stored data of a sheet with the stored data of more than two sheets. In such a case, the light intensity of the LED is switched to obtain an optimum level (about 1–2.5V), and after that, the output level of the amplifier is stored. Based on the stored level, a detection reference level for more than two sheets is set.

As described above, the levels, during the period when sheets are being fed sequentially, are measured and a given quantity of the measured data is accumulated, and simultaneously, the detection of double-feed is continued. As more dust attaches to the sensor, the value of the measurement data becomes lower. Therefore, when the value becomes lower than a predetermined level, the lowered value can be corrected by increasing the light intensity of the LED in order to prevent the apparatus from making incorrect decisions.

Figure 3A:
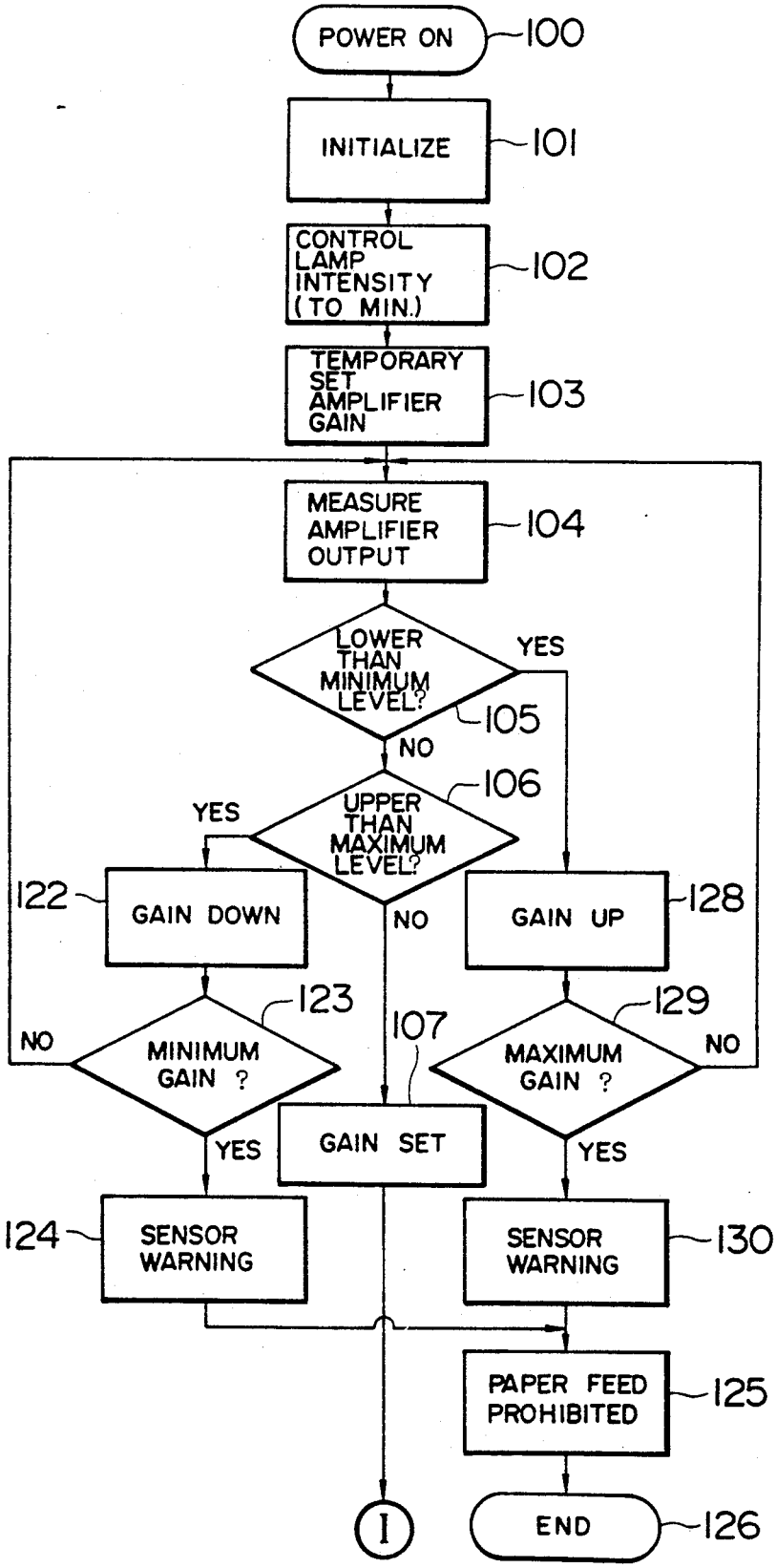
FIGS. 3A and 3B are a flow chart showing an operation of a central processing unit (CPU) in one embodiment of the invention.
Figure 3B:
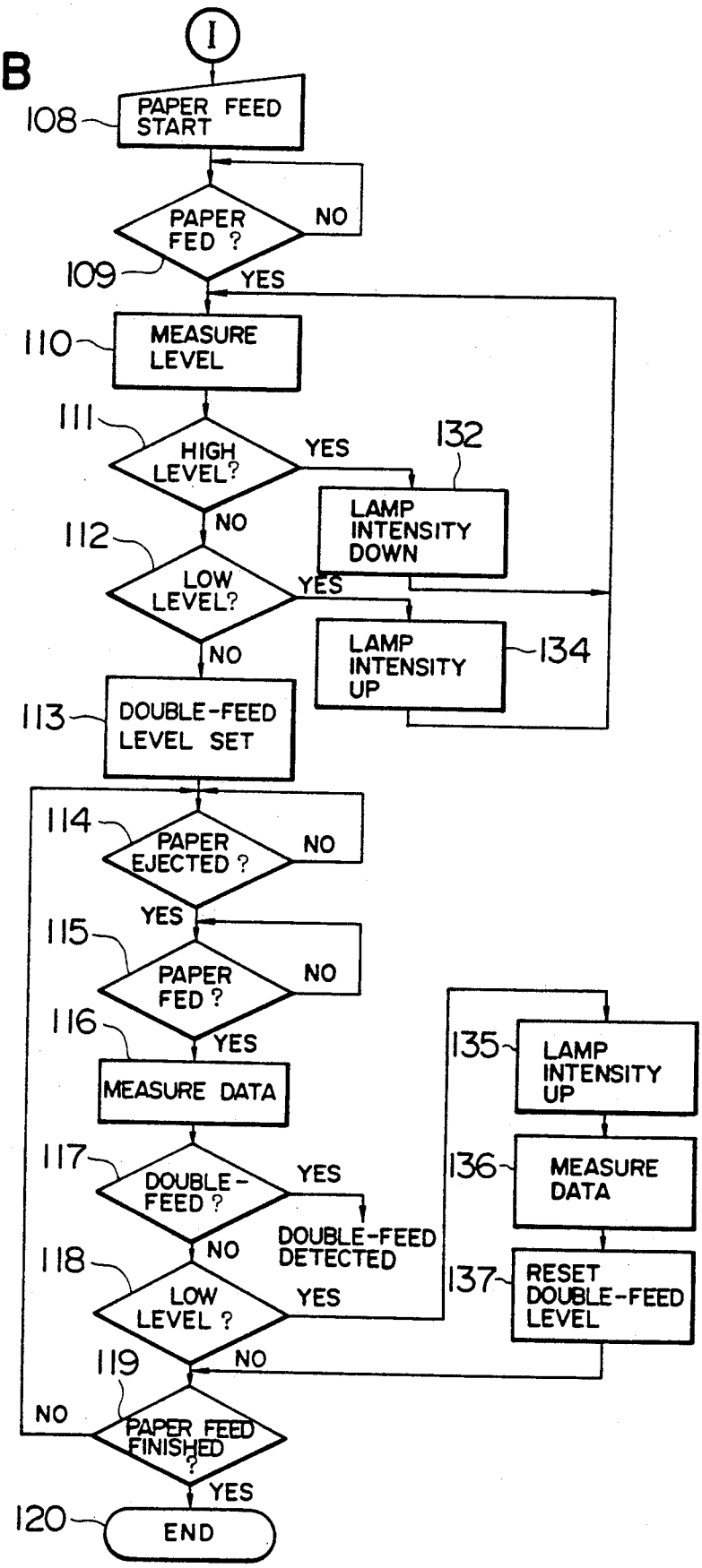

Referring to a flow chart shown in FIGS. 3A and 3B, the operation of the CPU in the above embodiment will be explained in detail. Step 101, which is mentioned below , is an initiating step. Steps 104–107 are temporary setting steps for setting temporarily the intensity of the light from the light emitting source and the gain of the amplifier. Steps 104–107, 122, 123, 128 and 129 are gain adjustment steps for adjusting the gain of the variable gain amplifier so that the output level of the variable gain amplifier may be a predetermined value, which is not in a saturation state, when a sheet of paper does not exist between the light emitting source and the light receiving sensor. Steps 108–113 and steps 132–134 are preparation steps for preparing a double-feed sheet detection by adjusting the output of the light emitting source so that the output of a sheet from the variable amplifier, during the period when the sheets are being fed, may be at a medium level lower than the output level during the period when the sheets are not being fed. Steps 114–117 are detection output transmission steps for transmitting a double-feed detection output when an output lower than a predetermined level, which is much lower than the above-mentioned level during the period when the sheets are being fed, is detected in the sequential paper feeding. Step 118, 135, 136 and 137 are correction steps for observing the output at a normal feeding and increasing the output of the light emitting source when the output is lowered.

Initiation of the apparatus, setting of the gain of the amplifier and so on are performed in accordance with a process which includes the following steps:

in Step 100, the power of the apparatus is turned on;

in Step 101, the apparatus is initiated;

in Step 102, the light intensity of the lamp is adjusted as low as possible;

in Step 103, the gain of the amplifier is temporarily set;

in Step 104, the output of the amplifier is measured;

in Step 105, it is judged whether or not the amplifier output is lower than the minimum level;

in Step 106, if it is judged that the amplifier output is not lower than the minimum level in the former step, it is judged whether or not it is higher than the maximum level;

in Step 107, if it is judged that the output is not higher than the maximum level in the former step, setting of the gain is completed;

in Step 122, if it is judged that the amplifier output is higher than the maximum level in Step 106, the gain is lowered;

in Step 123, it is judged whether or not the gain is the minimum. If it is not, Step 104 is repeated;

in Step 124, if it is judged that the gain is the minimum in the former step, the output is higher than the maximum level. Since the correct operation of the sensor is not assured in such a condition, a warning relative to the sensor is given;

in Step 125, the paper feeding is prohibited and the operation of the double-feed sheet detection is stopped in Step 126;

in Step 128, if the amplifier output is lower than the minimum in Step 105, the gain of the amplifier is increased;

in Step 129, it is judged whether or not the gain is at the maximum. If it is not, Step 104 is repeated; and in Step 130, if the gain is the maximum, the output is lower than the minimum level. Therefore, a warning relative to the sensor is given and Step 125 is executed.

When the gain of the amplifier is correctly set, paper feeding is started. If necessary, the light intensity of the lamp is adjusted and a level for two sheets is set:

in Step 108, paper feeding is started;

in Step 109, it is judged whether or not a sheet of paper is being fed;

in Step 110, the level of output is measured;

in Step 111, it is judged whether or not the level is high; in Step 132, if it is judged that the level is high in Step III, the light intensity of the lamp is lowered and Step 110 is repeated;

in Step 112, if it is judged that the level is not high in Step 111, it is judged whether or not it is low;

in Step 134, if it is judged that the level is low in Step 112, the light intensity of the lamp is increased and Step 110 is repeated; and in Step 113, the level for two sheets is set.

While the light intensity and the level is readjusted, if necessary, the double-feed sheet detection operation is continued.

in Step 114, it is judged whether or not the sheet is ejected. If the sheet is not ejected, the CPU waits until the sheet is ejected;

in Step 115, when it is confirmed that the sheet is ejected, the CPU waits until the subsequent sheet is fed;

in Step 116, when the subsequent sheet is fed, the data is measured;

in Step 117, it is judged whether or not double-feed has been caused, based on the measured data;

in Step 118, if it is judged that double-feed has not been caused in the former step, it is judged whether or not the level is low;

in Step 135, if it is judged that the level is low in Step 118, the light intensity is increased;

in Step 136, the data is measured;

in Step 137, the level for double-feed is reset and Step 119 is executed;

in Step 119, it is judged whether the paper feeding is completed. If it is not, Step 114 is repeated; if it is, in Step 120, the operation is stopped.

As explained in detail above, the CPU in the double-feed sheet detection apparatus of the invention initiates the double-feed detection apparatus when the power of the printer or the like is turned on. The CPU sets the light intensity of the light emitting lamp temporarily and sets the output level of the variable amplifier at a predetermined value during the time when no sheet is fed. Every time a sheet is fed, the output from the variable amplifier is measured, and if necessary, the light intensity of the light emitting lamp is adjusted, and then the doublefeed sheet detection level is set. Furthermore, every time a sheet is fed, the light intensity of the light emitting lamp is, if necessary, adjusted relative to the output from the variable amplifier when double-feed has not been caused.

Therefore, even if dust is accumulated and parts of the apparatus deteriorate, the detection performance can be automatically corrected by setting the gain of the amplifier at the beginning of the operation. Furthermore, when paper dust is attached to the sensor after a lot of sheets are fed, the performance of the sensor can be corrected by observing the output level sequentially and increasing the light intensity of the light emitting lamp if the level becomes under a predetermined level.

What is claimed is:

1. A double-feed sheet detection apparatus comprising:

a light-transmission sensor wherein a paper transport path is constituted between a light emitting source and a light receiving sensor;

a light control circuit for controlling the intensity of said light emitting source;

a variable gain amplifier for amplifying sequential outputs of said light-transmission sensor; and a central processing unit (CPU) for setting the intensity of said light emitting source and the gain of said variable gain amplifier, and for judging whether or not a double-feed has occurred based on the output of said variable gain amplifier, said central processing unit including:

means for initiating said detection apparatus when a sequential feeding operation is started;

means for temporarily setting the light intensity of said light emitting source and the gain of said variable gain amplifier;

means for adjusting the gain of said variable gain amplifier so that an output level of said variable gain amplifier may be a constant value, which is not in a saturation state, when no sheet of paper exists between said light emitting source and said light receiving sensor;

means for adjusting the output of said light emitting source so that, when a sheet of paper to be measured is supplied into said paper transport path, the output for the sheet of said variable gain amplifier may be on a medium level and lower than the level of the output of said variable gain amplifier during the period when no sheet is being fed;

means for transmitting a double-feed sheet detection output when an output lower than a fixed level, which is lower than the level during the period when the sheets are being fed, is detected in the sequential feeding operation; and means for comparing sequential outputs of said variable gain amplifier while the sheets are being fed one by one and for increasing the output of said light emitting source when a reduction in the output is found.

2. A double-feed sheet detection apparatus according to claim 1, wherein said light emitting source of said light-transmission sensor is an LED and said light control circuit for controlling the intensity of said light emitting source is a circuit which selects load resistances of said LED in response too a signal from said CPU.

3. A double-feed sheet detection apparatus according to claim 1, wherein the gain of said variable gain amplifier for amplifying the output of said light-transmission sensor is controlled by selecting feedback resistances in response to a signal from said CPU.

4. A double-feed sheet detection apparatus according to claim 1, wherein said gain adjusting means comprises means for giving a warning, displaying a prohibition of paper feeding, and stopping the sequential feeding operation when the output level, during the period when no sheet is being fed, cannot be adjusted to a fixed value, which is not in the saturation state.

5. A double-feed sheet detection apparatus comprising:

a light-transmission sensor having a light emitting source and a light receiving sensor with a paper transport path disposed therebetween;

a light control circuit for controlling the intensity of said light emitting source;

variable gain amplifier means for amplifying outputs of said light-transmission sensor, said amplifier means including an amplifier having two inputs, one of which receives the outputs of said light receiving sensor; and a gain control circuit, connected to the other input of said amplifier, for automatically adjusting the gain of said amplifier; and a central processing unit outputting first signals to said light control circuit and second signals to said gain control circuit for setting the intensity of said light emitting source and the gain of said variable gain amplifier means, respectively, and for judging whether or not a double-feed has occurred based on the output of said variable gain amplifier means.

6. A double-feed sheet detection apparatus according to claim 5, wherein said light emitting source of said light transmission sensor is an LED, and said light control circuit selects load resistances of said LED in response to the first signals received from said central processing unit.

7. A double-feed sheet detection apparatus according to claim 5, wherein said gain control circuit comprises a number of feedback resistances in parallel and a switch which selects feedback resistances in response to the second signals received from said central processing unit.

8. A double-feed sheet detection apparatus according to claim 5, wherein said central processing unit includes means for varying the second signals so that an output level of said variable gain amplifier means is at a constant value, which is not in a saturation state, when no sheet of paper exists in the paper transport path, and means for giving a paper feeding prohibition signal and stopping the paper feeding operation when the output level, during the period when no sheet is being fed, cannot be adjusted to a fixed value, which is not in the saturation state.

* * * * *